US005804959A

United States Patent [19]

Nakagawa et al.

[11] Patent Number: 5,804,959

[45] Date of Patent: Sep. 8, 1998

[54] SHUNT CORE TRANSFORMER WITH A SECOND SECONDARY COIL COMPRISED OF A FERROUS MATERIAL

[75] Inventors: Itaru Nakagawa; David Karl Fahlgren; Kazuhiro Uetsuki; Kazutoyo Nishio, all of Chula Vista, Calif.

[73] Assignee: Tabuchi Electric Company of America, Cordova, Tenn.

[21] Appl. No.: 802,798

[22] Filed: Feb. 18, 1997

[51] Int. Cl.[6] ..... H01F 17/00

[52] U.S. Cl. ..... 323/355; 336/177

[58] Field of Search ..... 323/248, 250, 323/254, 255, 331, 345, 340, 302; 336/155, 160, 165, 177, 212, 214, 215

[56] References Cited

U.S. PATENT DOCUMENTS

| | | | |
|---|---|---|---|
| 3,552,565 | 1/1971 | Fritz | 209/219 |
| 4,130,790 | 12/1978 | Heisey | 323/309 |
| 4,166,992 | 9/1979 | Brueckner et al. | 336/155 |
| 4,177,418 | 12/1979 | Brueckner et al. | 323/250 |
| 4,207,451 | 6/1980 | Tudbury | 219/672 |
| 5,187,428 | 2/1993 | Hutchison et al. | 323/250 |
| 5,235,488 | 8/1993 | Koch | 361/45 |
| 5,363,035 | 11/1994 | Hutchison et al. | 323/254 |
| 5,672,963 | 9/1997 | Corrigall et al. | 323/339 |

*Primary Examiner*—Adolf Berhane
*Attorney, Agent, or Firm*—Nixon & Vanderhye P.C.

[57] ABSTRACT

Disclosed is an improved shunt core transformer in which a primary winding drive generates a varying magnetic flux field around a transformer core which field thereby induces the plate voltage induces a voltage in both a first secondary and second secondary coil. The second secondary coil however is made of a ferrous material and thereby functions to shunt a portion of the flux generated directly from the central leg to the outer legs of the core bypassing the first secondary coil and thereby providing the known protections of a shunt core transformer.

17 Claims, 5 Drawing Sheets

Fig. 1 (PRIOR ART)
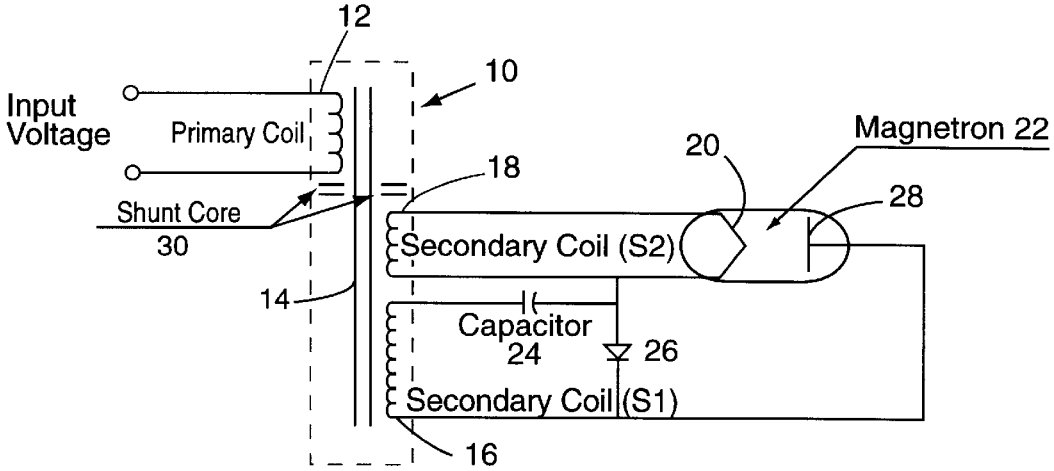
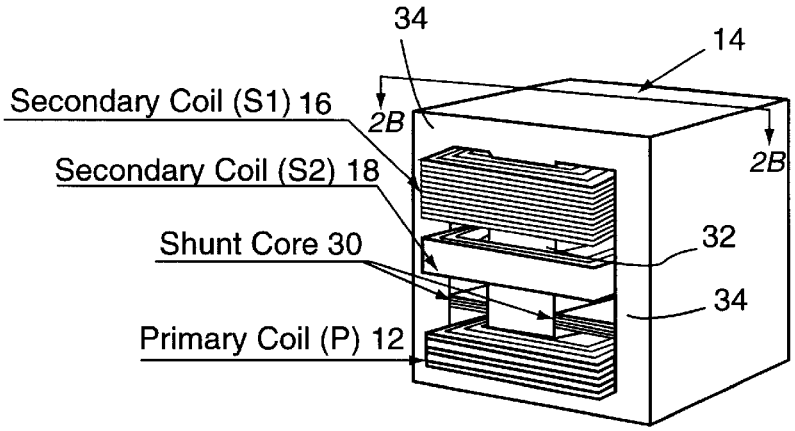
Fig. 2A (PRIOR ART)
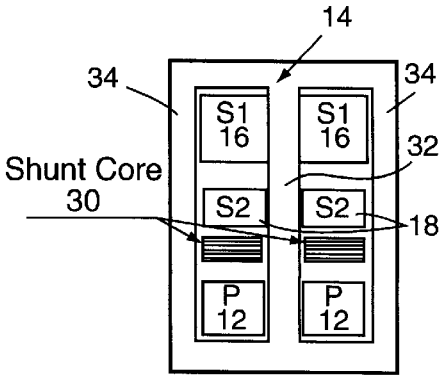
Fig. 2B (PRIOR ART)

Fig. 5
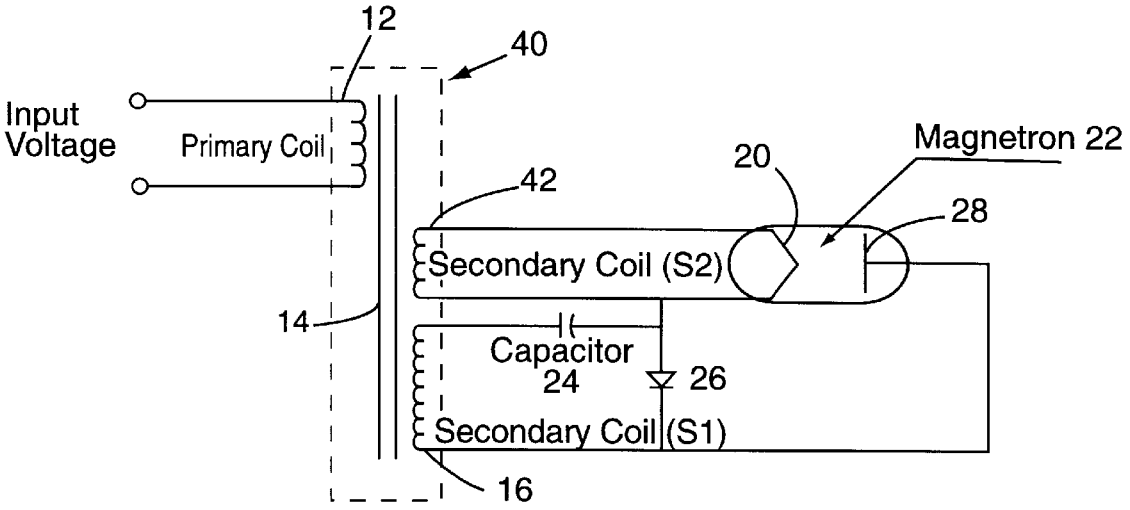
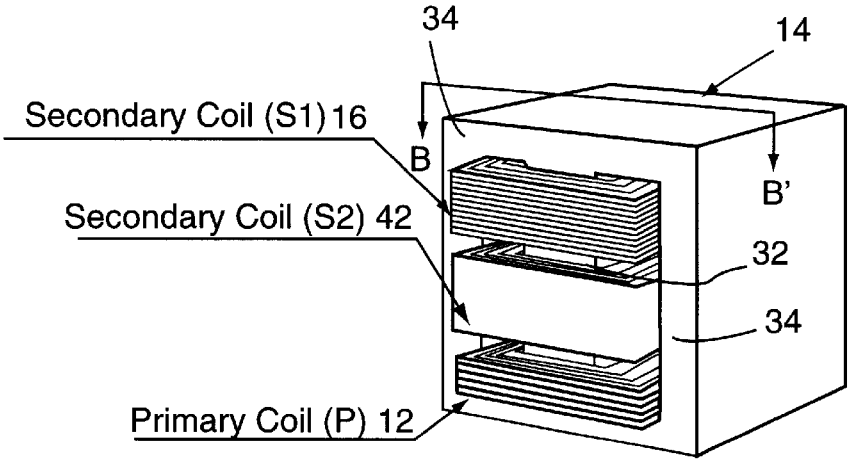
Fig. 6A
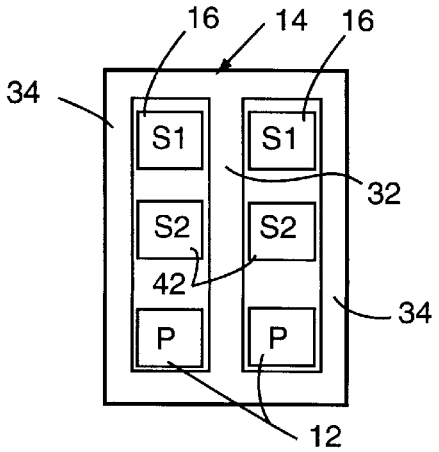
Fig. 6B

SHUNT CORE TRANSFORMER WITH A SECOND SECONDARY COIL COMPRISED OF A FERROUS MATERIAL

BACKGROUND OF THE INVENTION

1. Field of the Invention

The present invention relates to shunt core transformers in general and to shunt core transformers used to drive magnetron tubes in microwave oven in particular.

2. Description of the Prior Art

Shunt core transformers are well known and especially useful in the powering of magnetron tubes used in radar systems, microwave ovens, and the like. A typical prior art implementation of a shunt core transformer 10 is shown in FIG. 1 with the transformer being identified as the elements within the phantom lines. An alternating current input voltage is applied to the primary winding 12 and a varying flux is generated thereby in core 14. A first secondary coil 16 is wound around and in conjunction with the core, and a higher alternating current voltage is generated therein by the varying flux in the core and applied to the plate 28 of the magnetron 22. The voltage induced into a second secondary coil 18, again by the flux variations in core 14, is applied to the filament 20 of magnetron 22. As is well known, the filament is heated thereby and provides a source of electrons for operation of the magnetron.

As is known, the first secondary coil 16 is connected in series with capacitor 24 and across diode 26 and also across the filament 20 and plate 28 of magnetron 22. This applies the RF DC voltage between the plate and filament of the magnetron causing a varying RF electric field which, in conjunction with the magnetic field present in the magnetron (caused by magnets, not shown), causes the microwave generation in the high-Q cavity resonators (again not shown).

Also present in the shunt core transformer 10 is the presence of a shunt core 30 which is located between the primary coil and the first and second secondary coils. The shunt core 30 serves to divert a portion of the flux from the secondary coils and provides two desirable characteristics. First, it tends to support the resonant circuit developed by the inductance of the transformer coils, the load (in this case, the magnetron) and the external capacitor 24. This resonance can be appreciated by the existence of a reduced primary current in the primary coil at the nominal operating voltage. Secondly, when in use and the magnetron is in operation, the load is reduced on the secondary coils (especially the first secondary coil 16) and the shunting action of the shunt core 30 limits current available to the secondary coils thereby preventing overdriving of the magnetron.

The construction and arrangement of elements in a conventional shunt core transformer are shown in FIGS. 2A, 2B, 3, and 4. FIG. 4 illustrates a three leg transformer core 14 commonly called an "E-I core lamination" in the industry (due to the obvious shape of the cores), but here only the "E" core is shown for clarity of illustration - it is understood that after assembly, an "I" core would be welded across the open end of the "E" core in the manner of FIGS. 2A, 2B, 6A & 6B. The three leg transformer core 14 has a central leg 32 around which the coils are wound (or around which a bobbin is placed upon which the coils are actually wound) with outer legs 34 extending on the outer portion of the coils. The location of shunt core 30 relative to the primary and secondary windings is clearly visible in FIG. 4 where phantom lines 36 illustrate the flux flow through shunt core 30 with phantom lines 38 indicating the normal unshunted flux flow.

As is well known, the primary and secondary coils are wound of insulated copper wire with the appropriate number of windings to provide the desired filament and plate voltages on the magnetron and to handle the necessary current flow to provide the appropriate power to the magnetron.

It can be seen that the requirement of both a secondary coil 18 and the shunt core 30 by definition requires the shunt core transformer to be relatively tall (the vertical direction as seen in FIG. 2B). Additionally, the installation of two structures (the second secondary winding and the shunt core) requires additional manufacturing effort and cost. Finally, the relatively heavy shunt core 30 as well as the heavy secondary coil winding make the shunt core transformer, and structures utilizing such transformer, inordinately heavy thereby increasing the cost due to shipping, packaging, etc.

SUMMARY OF THE INVENTION

It is an object of the present invention to reduce the size, weight, and complexity of a conventional shunt core transformer.

It is a further object of the present invention to combine the beneficial aspects of a shunt core with the requirement of a second secondary coil into a single structure thereby simplifying manufacturing of a shunt core transformer.

It is a still further object of the present invention to shorten the distance between a primary coil and the first secondary coil in a shunt coil transformer thereby increasing the efficiency of the transforming action.

It is an additional object of the present invention to increase the "window" or design area inside the transformer to allow design alternatives, and thereby simplify the assembly of the transformer.

The above and other objects are achieved in accordance with the present invention by utilizing a second secondary coil made of a ferrous material. The amount of ferrous material is sufficient such that when located between the primary coil and the first secondary coil, a sufficient amount of flux is shunted past the first secondary coil so as to provide the shunt core benefits. However, because the secondary coil is in fact a coil, it also provides the desired transforming action to provide power to the filament winding. The utilization of a ferrous material in the second secondary coil eliminates the need for a separate shunt core while maintaining the benefits normally achieved thereby.

BRIEF DESCRIPTION OF THE DRAWINGS

The above, as well as other advantages and features of this invention, will be more completely understood and appreciated by review of presently preferred exemplary embodiments taken in conjunction with the accompanying drawings, of which:

FIG. 1 is an electrical schematic of a prior art shunt core transformer connected to a magnetron;

FIG. 2A is a perspective view and FIG. 2B is a front sectional view of a prior art shunt core transformer;

FIG. 5 is an electrical schematic of the present invention connected to a conventional magnetron;

FIG. 6A is a perspective and FIG. 6B is a front cross-sectional view of the transformer in accordance with the present invention;

DETAILED DESCRIPTION OF PREFERRED EMBODIMENTS

Figure 3:
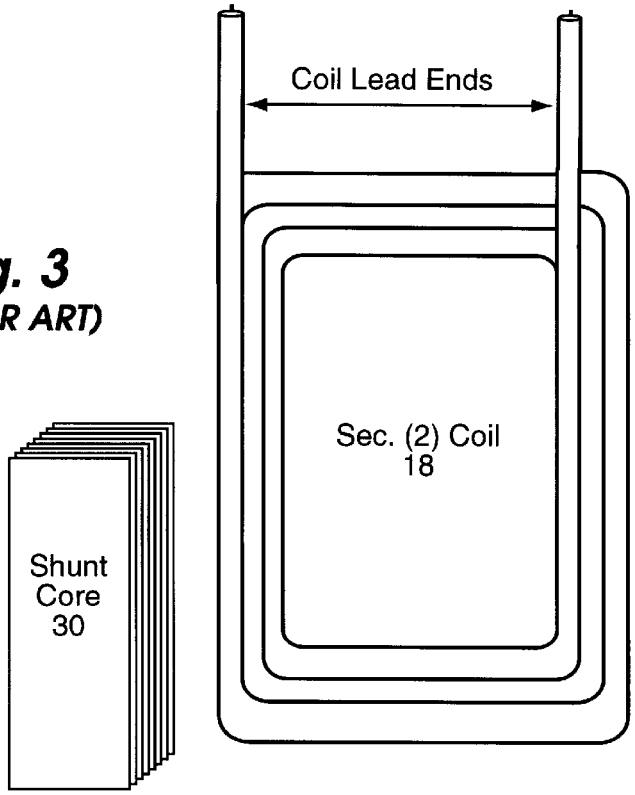
Fig. 3 (PRIOR ART)
FIG. 3 is a front perspective view of a second secondary coil and a shunt core utilized in a prior art shunt core transformer.
Figure 4:
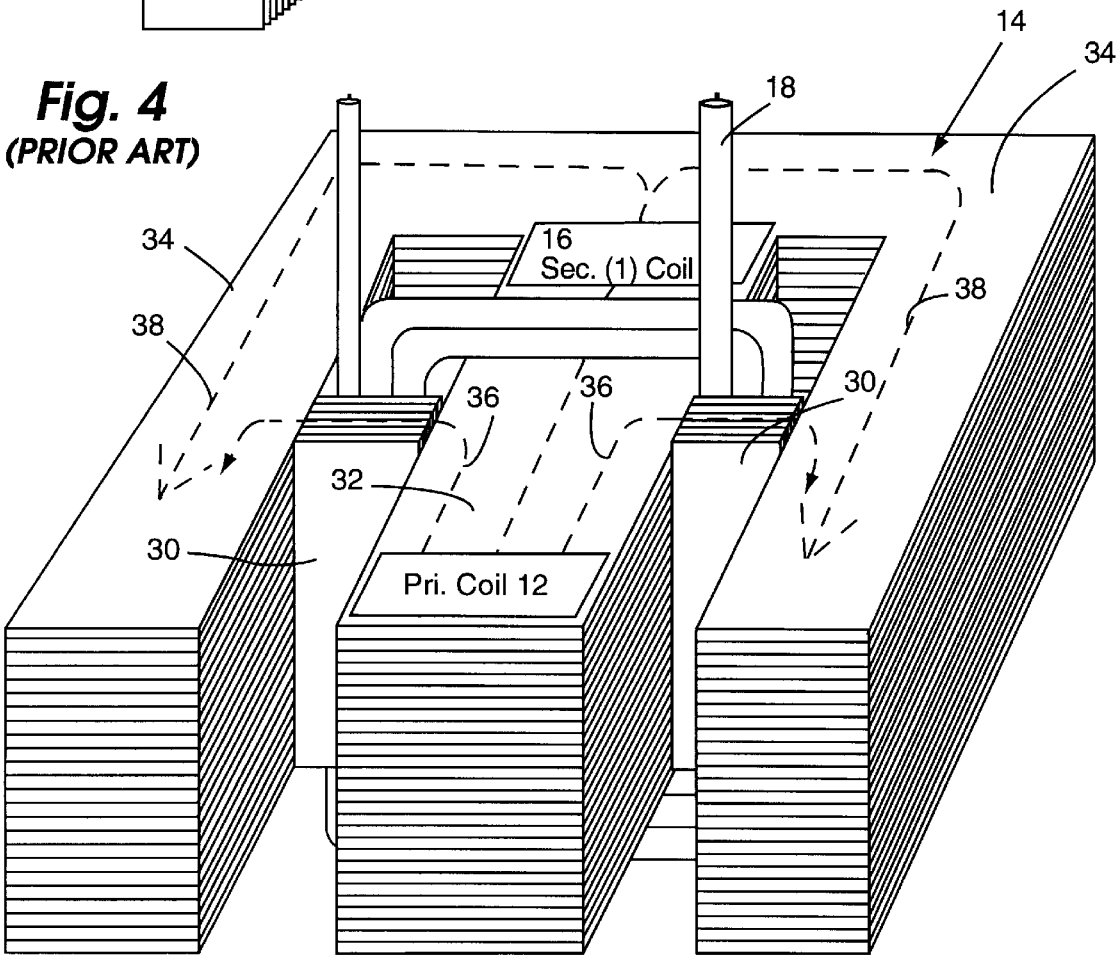
Fig. 4 (PRIOR ART)
FIG. 4 is a perspective view of a prior art shunt core transformer.

In discussion of the preferred embodiments illustrated in the accompanying drawings, similar numbering will be used for similar structures among these several views.

In FIG. 5, an improved shunt core transformer 40 in accordance with the present invention is shown connected to a conventional magnetron 22. The primary coil 12 can be the same size or an altered size with respect to the primary coil of a prior art shunt core transformer due to a slight increase in efficiency of the present invention and/or the increase in available area within the lamination core window. Additionally, the transformer core 14 also may be the same as or different from the transformer core discussed in conjunction with the prior art shunt core transformer in FIGS. 1–4. Similarly, the first secondary coil 16 size and/or shape can be altered, also because of either the slight increase in efficiency of the transformer and/or the increase in available area within the lamination core window as compared to the first secondary coil in the prior art shunt core transformer 10 previously discussed. However, in a preferred embodiment of the present invention, the second secondary coil 42 is comprised of a plurality of windings of ferrous material. In a preferred embodiment, these are plate-like helical coils of soft steel or iron which may be of the same material as the laminated core 14.

Figure 7:
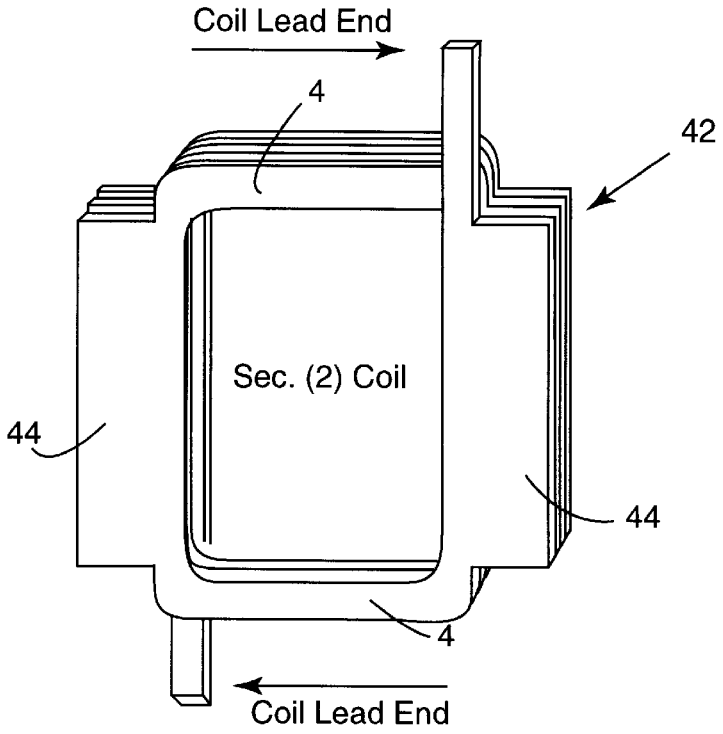
FIG. 7 is a perspective view of the second secondary coil in accordance with the present invention.

FIG. 7 illustrates the second secondary coil 42 in accordance with the present invention in which the laminations of ferrous material can clearly be seen. In a preferred embodiment of the second secondary coil, the portion of the laminated windings located between the central leg 32 and the outer legs 34 are expanded to essentially bridge the gap between the central and outer legs. This expanded portion 44 is clearly seen in FIG. 7. Because the portions of the coil not in the gap between the central and outer legs of the core do not conduct any flux, they can be of a smaller width since their sole function is to carry the current flow induced in the second secondary coil and these reduced portions 46 are also shown in FIG. 7.

Figure 8:
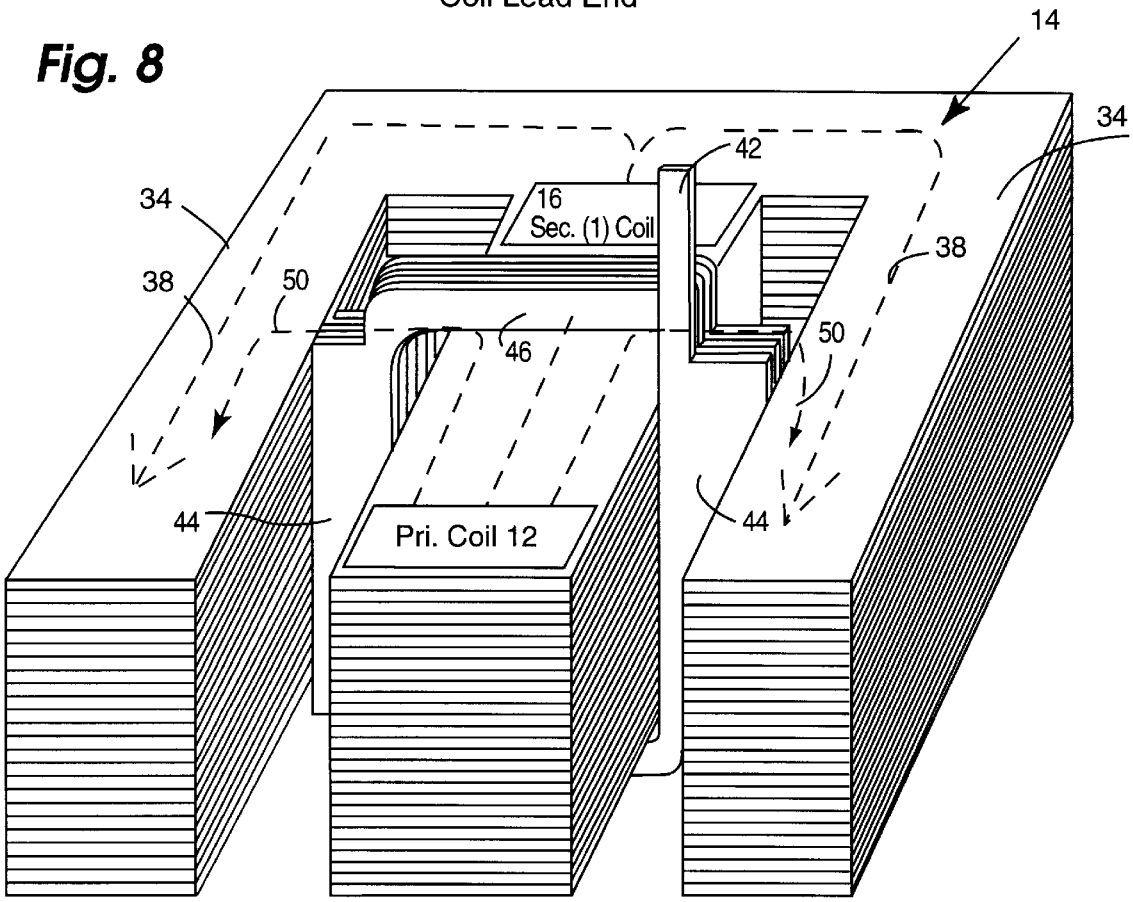
FIG. 8 is a perspective view of the second secondary coil mounted in accordance with the present invention.

FIG. 8 illustrates the operation of the present invention. For clarity of understanding, the transformer core 14 with its central leg 32 and outer legs 34 and the positioning of the primary coil 12 and the first secondary coil 16 are shown as originally shown in FIG. 4. However, it is understood that, in a preferred embodiment of the present invention, the length of the three legs could be reduced as could the size of the primary and first secondary coils due to the increase in efficiency caused by the combination of the prior art shunt core and second secondary coil into a single unitary structure, i.e., second secondary coil 42. It can be seen that while the second secondary coil 42 operates in a manner similar to the second secondary coil 18 in the prior art, i.e., it intercepts magnetic flux from the core and provides the appropriate power for operation of filament 22, it also serves as a shunt path for a portion of the magnetic flux carried by core 14. Its construction and the fact that it is made of a ferrous material serves to conduct the shunt core flux as shown in phantom lines 50.

In accordance with the present invention, the first secondary coil could be made with greater width, i.e., more turns could be wound per layer. This in turn allows reductions in the total layers required such that a reduction in the amount of copper which is required for the first secondary coil. Allowing more coil height permits coils with more turns allowing new coil designs which were not previously considered due to "window" area limitations. Additionally, in view of the increased "window" area, the guage of the magnet wire can be changed reflecting possible material savings.

Thus, because the present invention utilizes a single structure, in the form of second secondary coil 42 made of a ferrous material, which accomplishes two functions, i.e., the function of the second secondary coil winding and the function of the prior art shunt core, the present invention is a more efficient structure. This efficiency is reflected in both the manufacture of the structure, i.e., only one part needs to be assembled rather than two separate parts, as well as the characteristics of the finished product, i.e., for the same power capabilities, smaller and lighter in weight than the prior art shunt core transformers.

Figure 9:
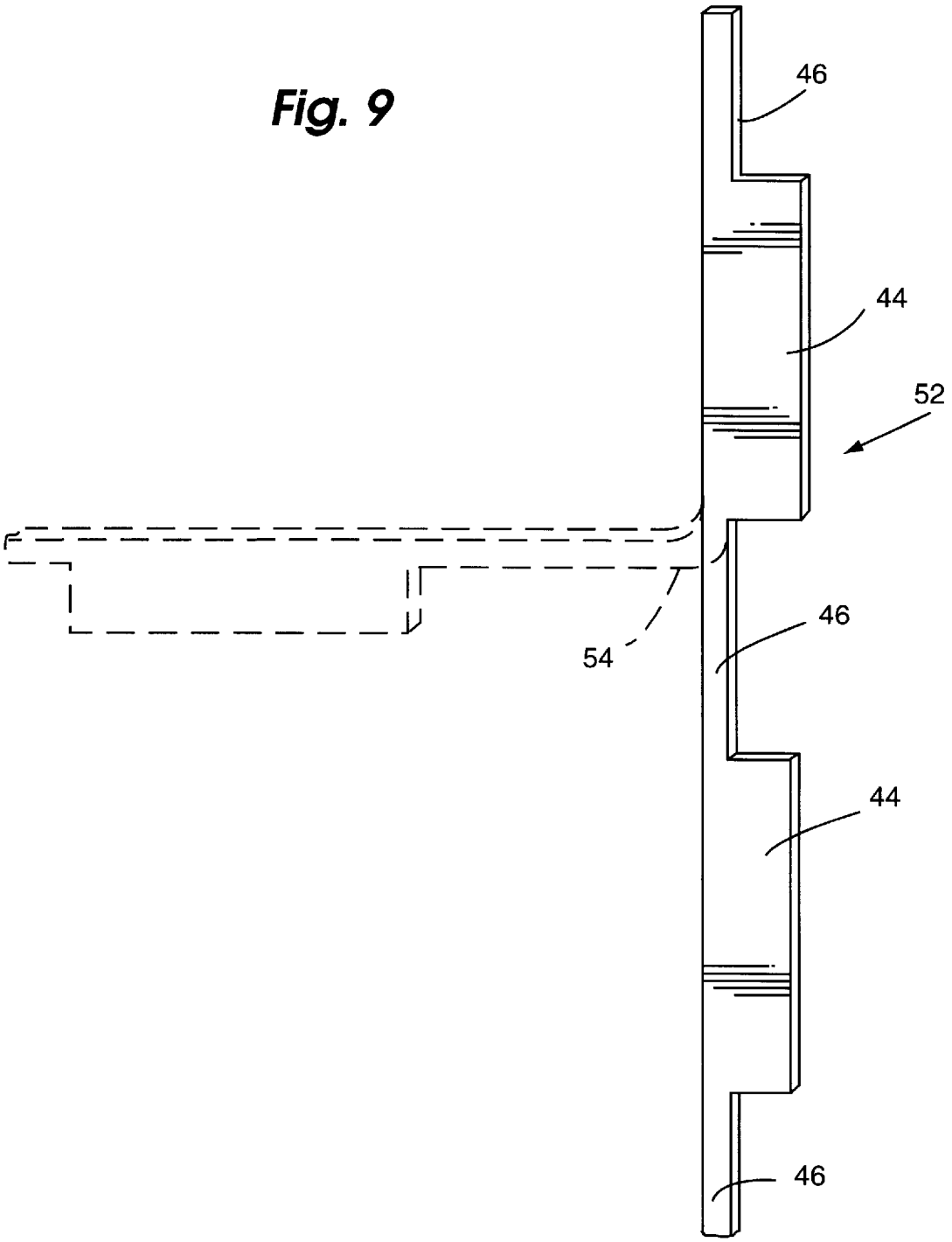
FIG. 9 is a perspective view of a portion of the second secondary coil before and after the first bending step to form the second secondary coil.

FIG. 9 illustrates the manner in which the second secondary coil 42 in accordance with the present invention may be created. An initial string 52 of ferrous material, preferably soft steel or iron, having expanded portions 44 and reduced portions 46 is created either by stamping, hot or cold rolling, etc. The string is then curved at the reduced portion in the plane of the expanded portion 44, where the first such bend is shown in phantom lines at 54. A former or other structure may be utilized to aid in the in-plane bending of string 52. Subsequent bends are made at the appropriate positions until the helical second secondary coil 42 as shown in FIG. 7 is formed. This coil is then assembled onto the conventional or shortened three leg core 14 as previously discussed and illustrated in FIG. 8. The second secondary coil may be assembled after the first secondary coil has been located on the central leg and before the primary coil is located thereon.

Depending upon the specific application, it will be readily apparent to those of ordinary skill in the art that numerous modifications of the present invention would be appropriate. Quite clearly any ferrous material capable of providing a reduced reactance flow path for shunt flux could be utilized. While a preferred embodiment utilizes soft steel or iron because of its high ductility and ease of bending, numerous other materials will be obvious to one of ordinary skill in the art.

Furthermore, although the resistance of soft iron or steel to current flow is somewhat greater than the conventional copper windings, the increased cross-sectional area even in the regions of the reduced portion 46 will result in substantially similar or only slightly higher resistance and/or heat generation during operation. The reduced portions 46 can even include a copper or other material plated thereon to improve current flow and reduce resistance in the reduced portions. While a preferred method of creating the second secondary coil is by bending, it will be appreciated that the creation of a spiral of laminations as shown in FIG. 7 could be duplicated by utilizing a plurality of planar sections and electrically interconnecting each of the sections in series by plating, welding, soldering, or other conventional connecting methods.

Accordingly, the present invention is limited only by the claims appended hereto and, in the broadest sense, is not limited to the specific examples included in this application.

What is claimed is:

1. A transformer comprising:

a transformer core for conduction of magnetic flux generated by the transformer;

a primary coil for generating a magnetic flux field in said transformer core;

a first secondary coil, in response to magnetic flux in said transformer core, for generating a first voltage output, said first secondary coil in conjunction with an external capacitor comprising a resonant circuit; and a second secondary coil, in response to magnetic flux in said transformer core, for generating a second voltage output, said second secondary coil comprised of a ferrous material for shunting at least a portion of said magnetic flux past said first secondary coil.

2. The transformer according to claim 1, wherein said transformer core includes a three leg core having a center leg and two outer legs, said outer legs spaced apart from said center leg, said primary and two secondary coils mounted around the center leg of said three leg core.

3. The transformer according to claim 2, wherein said second secondary coil separates said primary coil and said first secondary coil on said center leg.

4. The transformer according to claim 1, wherein said primary coil and said first secondary coil are each comprised of a plurality of copper windings.

5. The transformer according to claim 1, wherein said second secondary coil is comprised of a plurality of planar soft steel winding.

6. The transformer according to claim 1, wherein said transformer core is comprised of planar soft steel laminations.

7. The transformer according to claim 5, wherein said transformer core includes a three leg core having a center leg and two outer legs, said outer legs spaced apart from said center leg, said primary and two secondary coils mounted around the center leg of said three leg core, said second secondary winding is comprised of a plurality of planar coils, at least one coil including two expanded portions and two reduced portions, said expanded portions located respectively between said center leg and said outer legs.

8. The transformer according to claim 3, wherein said transformer core is comprised of a plurality of planar soft steel laminations.

9. An improved shunt core transformer for supplying power to a magnetron, where such a transformer includes a core for conduction of magnetic flux generated by the transformer; a primary coil for generating a magnetic flux field in said transformer core; a first secondary coil which, in response to magnetic flux in said transformer core, and in conjunction with an external capacitor comprises a resonant circuit for generating an RF magnetron plate voltage output to said magnetron, and a second secondary coil which, in response to magnetic flux in said transformer core, generates a magnetron filament voltage output, wherein the improvement comprises said second secondary coil being comprised of a ferrous material and thereby shunting at least a portion of said magnetic flux past said first secondary coil.

10. The transformer according to claim 9, wherein said transformer core includes a three leg core having a center leg and two outer legs, said primary and two secondary coils mounted around the center leg of said three leg core.

11. The transformer according to claim 10, wherein said second secondary coil separates said primary coil and said first secondary coil on said center leg.

12. The transformer according to claim 9, wherein said primary coil and said first secondary coil are each comprised of a plurality of copper windings.

13. The transformer according to claim 9, wherein said second secondary coil is comprised of a plurality of planar soft steel winding.

14. The transformer according to claim 9, wherein said transformer core is comprised of a plurality of planar soft steel laminations.

15. The transformer according to claim 13, wherein said transformer core includes a three leg core having a center leg and two outer legs, said outer legs spaced apart from said center leg, said primary and two secondary coils mounted around the center leg of said three leg core, said second secondary winding is comprised of a plurality of planar coils, at least one coil including two expanded portions and two reduced portions, said expanded portions located respectively between said center leg and said outer legs.

16. A method of improving shunt core transformers for supplying power to a magnetron, where such a transformer includes a core for conduction of magnetic flux generated by the transformer; a primary coil for generating a magnetic flux field in said transformer core; a first secondary coil which, in response to magnetic flux in said transformer core, and in conjunction with an external capacitor comprises a resonant circuit for generating an RF magnetron plate voltage output to said magnetron, and a second secondary coil which, in response to magnetic flux in said transformer core, generates a magnetron filament voltage output, said method comprises the step of using said second secondary coil for shunting at least a portion of said magnetic flux past said first secondary coil by means of said second secondary coil being comprised of a ferrous material.

17. A method of making a second secondary coil in a shunt core transformer, where such a transformer includes a three leg core for conduction of magnetic flux generated by the transformer; a primary coil for generating a magnetic flux field in said transformer core; a first secondary coil which, in response to magnetic flux in said transformer core, and in conjunction with an external capacitor comprises a resonant circuit for generating an RF magnetron plate voltage output to said magnetron, and a second secondary coil which, in response to magnetic flux in said transformer core, generates a magnetron filament voltage output, said method comprises the steps of:

providing a string of planar ferrous material having expanded portions and reduced portions; and in plane bending of said string to form a generally rectangular helical winding, said helical winding having expanded portions on opposing sides and having reduced portions on opposite sides, where said expanded portions are sized to fit between the legs of said transformer core.

* * * * *